US008377312B2

(12) United States Patent
Domke et al.

(10) Patent No.: US 8,377,312 B2
(45) Date of Patent: Feb. 19, 2013

(54) ENRICHMENT OF ORES FROM MINE TAILINGS

(75) Inventors: Imme Domke, Mannheim (DE); Alexej Michailovski, Ludwigshafen (DE); Norbert Mronga, Dossenheim (DE)

(73) Assignees: BASF SE, Ludwigshafen (DE); Siemens AG, Munich (DE)

( * ) Notice: Subject to any disclaimer, the term of this patent is extended or adjusted under 35 U.S.C. 154(b) by 74 days.

(21) Appl. No.: 13/139,091

(22) PCT Filed: Dec. 9, 2009

(86) PCT No.: PCT/EP2009/066693

§ 371 (c)(1),
(2), (4) Date: Jun. 10, 2011

(87) PCT Pub. No.: WO2010/066770

PCT Pub. Date: Jun. 17, 2010

(65) Prior Publication Data

US 2011/0240527 A1 Oct. 6, 2011

(30) Foreign Application Priority Data

Dec. 11, 2008 (EP) ..... 08171310

(51) Int. Cl.
*B03C 1/015* (2006.01)

(52) U.S. Cl. ..... 210/695; 210/679; 210/714; 210/724; 210/222; 209/5; 209/8; 209/9; 209/39; 209/214

(58) Field of Classification Search ..... 210/679, 210/695, 714, 724, 222; 209/5, 8, 9, 39, 209/214

See application file for complete search history.

(56) References Cited

U.S. PATENT DOCUMENTS

| | | | |
|---|---|---|---|
| 4,657,666 | A | 4/1987 | Snook et al. |
| 4,834,898 | A | 5/1989 | Hwang |
| 5,043,070 | A | 8/1991 | Hwang |
| 5,161,694 | A | 11/1992 | Yoon et al. |
| 2010/0200510 | A1 | 8/2010 | Domke et al. |
| 2010/0300941 | A1 | 12/2010 | Domke et al. |
| 2010/0307982 | A1 | 12/2010 | Domke et al. |
| 2011/0000826 | A1 | 1/2011 | Diez et al. |
| 2011/0120919 | A1 | 5/2011 | Domke et al. |
| 2011/0120954 | A1 | 5/2011 | Domke et al. |
| 2011/0163278 | A1 | 7/2011 | Domke et al. |
| 2011/0229384 | A1 | 9/2011 | Michailovski et al. |
| 2011/0272623 | A1 | 11/2011 | Domke et al. |
| 2011/0303772 | A1 | 12/2011 | Michailovski et al. |
| 2011/0303773 | A1 | 12/2011 | Domke et al. |
| 2011/0309003 | A1 | 12/2011 | Domke et al. |
| 2012/0000857 | A1 | 1/2012 | Domke et al. |
| 2012/0058463 | A1 | 3/2012 | Deuerlein et al. |

FOREIGN PATENT DOCUMENTS

| | | |
|---|---|---|
| WO | 02 066168 | 8/2002 |
| WO | 2007 008322 | 1/2007 |
| WO | WO 2009/101070 A2 | 8/2009 |
| WO | WO 2010/060698 A2 | 6/2010 |

OTHER PUBLICATIONS

Translation of the International Preliminary Report on Patentability for PCT/EP2010/052668, Sep. 4, 2011.*

Gray, S.; et al. "Recovery of Fine Gold Particles by Flocculation with Hydrophobic Magnetite." Extractive Metallurgy Conference. pp. 223-226 (Oct. 1991).

International Search Report issued Feb. 24, 2010 in PCT/EP09/66693 filed Dec. 9, 2009.

* cited by examiner

*Primary Examiner* — David A Reifsnyder

(74) *Attorney, Agent, or Firm* — Oblon, Spivak, McClelland, Maier & Neustadt, L.L.P.

(57) ABSTRACT

The present invention relates to a process for separating at least one first material from a mixture comprising this at least one first material in an amount of from 0.001 to 1.0% by weight, based on the total mixture, and at least one second material, which comprises at least the following steps:

(A) contacting of the mixture comprising at least one first material and at least one second material with at least one surface-active substance, if appropriate in the presence of at least one dispersion medium, with the surface-active substance binding to the at least one first material, (B) if appropriate, addition of at least one dispersion medium to the mixture obtained in step (A) in order to obtain a dispersion, (C) treatment of the dispersion from step (A) or (B) with at least one hydrophobic magnetic particle so that the at least one first material to which the at least one surface-active substance is bound and the at least one magnetic particle agglomerate, (D) separation of the agglomerate from step (C) from the mixture by application of a magnetic field, (E) if appropriate, dissociation of the agglomerate separated off in step (D) in order to obtain the at least one first material and the at least one magnetic particle separately.

20 Claims, No Drawings

ENRICHMENT OF ORES FROM MINE TAILINGS

The present invention relates to a process for separating at least one first material from a mixture comprising this at least one first material in an amount of from 0.001 to 1.0% by weight, based on the total mixture, and at least one second material, in which the first material is firstly brought into contact with a surface-active substance in order to hydrophobicize it, this mixture is then brought into contact with at least one magnetic particle so that the magnetic particle and the hydrophobicized first material agglomerate and this agglomerate is separated from the at least one second material by application of a magnetic field and the at least one first material is then preferably quantitatively separated from the magnetic particle, with the magnetic particle preferably being able to be recirculated to the process.

In particular, the present invention provides a process for the enrichment of ores from mine tailings.

Processes for separating ores from mixtures are already known from the prior art.

WO 02/0066168 A1 relates to a process for separating ores from mixtures, in which suspensions or slurries of these mixtures are treated with particles which are magnetic and/or can float in aqueous solutions. After addition of the magnetic and/or floatable particles, a magnetic field is applied so that the agglomerates are separated off from the mixture. However, the degree of attachment of the magnetic particles to the ore and the strength of the bond are not sufficient to carry out the process with a sufficiently high yield and effectiveness.

U.S. Pat. No. 4,657,666 discloses a process for the enrichment of ores, in which the ore present in the gangue is reacted with magnetic particles, resulting in formation of agglomerates due to the hydrophobic interactions. The magnetic particles are hydrophobicized on the surface by treatment with hydrophobic compounds so that attachment to the ore occurs. The agglomerates are then separated off from the mixture by means of a magnetic field. The document also discloses that the ores are treated with a surface-activating solution of 1% of sodium ethylxanthogenate before the magnetic particle is added. In this process, separation of ore and magnetic particle is effected by destruction of the surface-activating substance.

U.S. Pat. No. 4,834,898 discloses a process for separating off nonmagnetic materials by bringing them into contact with magnetic reagents which are enveloped in two layers of surface-active substances. U.S. Pat. No. 4,834,898 further discloses that the surface charge of the nonmagnetic particles which are to be separated off can be influenced by various types and concentrations of electrolyte reagents. For example, the surface charge is altered by addition of multivalent anions, for example tripolyphosphate ions.

S. R. Gray, D. Landberg, N. B. Gray, Extractive Metallurgy Conference, Perth, 2-4 Oct. 1991, pages 223-226, discloses a process for recovering small gold particles by bringing the particles into contact with magnetite. Before the contacting, the gold particles are treated with potassium amylxanthogenate. A process for separating off the gold particles from at least one hydrophilic material is not disclosed in this document.

WO 2007/008322 A1 discloses a magnetic particle which is hydrophobicized on the surface for the separation of impurities from mineral substances by magnetic separation processes. According to WO 2007/008322 A1, a dispersant selected from among sodium silicate, sodium polyacrylate and sodium hexametaphosphate can be added to the solution or dispersion.

The prior art does not disclose any processes by means of which it is possible to separate off the small amounts of ores present in "tailings", i.e. mine wastes which have only a small proportion of ores after winning of the ores by conventional processes such as flotation or other magnetic processes. A reason is that the milling of the ore forms a not negligible proportion of very fine particles having diameters below 10 μm and these very fine particles are difficult to separate off by flotation.

It is an object of the present invention to provide a process by means of which at least one first material can be separated off efficiently by magnetic means from mixtures comprising at least one first material and at least one second material, especially when this first material is present in a particularly low concentration in the mixture. In particular, it is an object of the present invention to provide a process by means of which ores present in low concentration in mine tailings can be recovered. Furthermore, it is an object of the present invention to treat the first material to be separated off in such a way that the agglomerate of the magnetic particle and the first material is sufficiently stable to ensure a high yield of the first material in the separation.

These objects are achieved by a process for separating at least one first material from a mixture comprising this at least one first material in an amount of from 0.001 to 1.0% by weight, based on the total mixture, and at least one second material, which comprises at least the following steps:

(A) contacting of the mixture comprising at least one first material and at least one second material with at least one surface-active substance, if appropriate in the presence of at least one dispersion medium, with the surface-active substance binding to the at least one first material, (B) if appropriate, addition of at least one dispersion medium to the mixture obtained in step (A) in order to obtain a dispersion, (C) treatment of the dispersion from step (A) or (B) with at least one hydrophobic magnetic particle so that the at least one first material to which the at least one surface-active substance is bound and the at least one magnetic particle agglomerate, (D) separation of the agglomerate from step (C) from the mixture by application of a magnetic field, (E) if appropriate, dissociation of the agglomerate separated off in step (D) in order to obtain the at least one first material and the at least one magnetic particle separately.

The process of the invention serves to separate off the at least one first material from mixtures comprising at least one first material in a low concentration and at least one second material.

The mixtures to be treated by the process of the invention, which comprise at least one first material in a low concentration in addition to at least one second material, are, for example, the "tailings" which remain after the major part of ores has been separated off by conventional processes known to those skilled in the art and whose content of ores is too low for conventional processes, for example flotation processes. Furthermore, the ore particles which remain cannot be separated off by conventional processes because of their excessively small diameter, for example less than 10 μm.

It is also possible, but not preferred, for mixtures which occur naturally with the low concentration according to the invention of ores to be treated by the process of the invention.

For the purposes of the present invention, "hydrophobic" means that the corresponding particle can have been hydrophobicized subsequently by treatment with the at least one surface-active substance. It is also possible for an intrinsically hydrophobic particle to be additionally hydrophobicized by treatment with the at least one surface-active substance.

In a preferred embodiment of the process of the invention, a mixture comprising the at least one first material and the at least one second material is treated, with the surface properties of the materials mentioned differing so that the at least one first material, preferably a metal compound as ore, can be selectively hydrophobicized in the presence of the at least one second material, preferably a further metal compound which is not an ore. Particularly preferably first and second materials are mentioned below.

The at least one first material to be separated off is thus preferably a metal compound selected from the group consisting of compounds of the transition metals, for example Cu, Mo, Ag, Au, Zn, W, Pt, Pd, Rh, etc., and Sn, Pb, As and Bi, sulfidic ores, oxidic and/or carbonate-comprising ores, for example azurite [$Cu_3(CO_3)_2(OH)_2$] or malachite [$Cu_2[(OH)_2|CO_3]$], or noble metals in elemental form, to which a surface-active compound can bind, preferably selectively, to produce hydrophobic surface properties.

The at least one second material is preferably a hydrophilic metal compound, particularly preferably selected from the group consisting of oxidic and hydroxidic metal compounds, for example silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$, $Al_2O_3$, FeO(OH), $FeCO_3$, $Fe_2O_3$, $Fe_3O_4$ and further related minerals and mixtures thereof.

Examples of sulfidic ores which can be used according to the invention are, for example, selected from the group of copper ores consisting of covellite CuS, molybdenum(IV) sulfide, chalcopyrite (copper pyrite) $CuFeS_2$, bornite $Cu_5FeS_4$, chalcocite (copper glance) $Cu_2S$, pentlandite $(Ni, Fe)_{1-x}S$, zinc blende and wurtzite, in each case ZnS, galenite PbS and mixtures thereof. Noble metals which are preferably present in elemental form are, for example, Ag, Au, Pt, Pd or Rh.

Suitable oxidic metal compounds which can be used according to the invention are preferably selected from the group consisting of silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$ and further related minerals and mixtures thereof.

Accordingly, the process of the invention is preferably carried out using ore mixtures which can be obtained by treatment of mine deposits by conventional processes for separating off the ores. Conventional processes are known to those skilled in the art, for example conventional flotation, in particular special processes such as ultraflotation or carrier flotation, or leaching processes such as dump leaching, heap leaching or tank leaching. These mine wastes referred to as tailings differ from conventional ores obtained in mines in that the concentration of the ores or the noble metals in the tailings is significantly lower than in the original ores. Furthermore, the tailings can be present as finely particulate residues in the form of slurries; for example the particles have diameters of from 20 to 50 μm. However, larger particles can also be present. In contrast to ores obtained in mines, tailings can also comprise impurities in the form of organic compounds and/or salts and can possibly have a pH which deviates from the neutral pH of the original ore, i.e. is in the acidic or basic range.

In a preferred embodiment of the process of the invention, the mixture comprising at least one first material and at least one second material is present in the form of particles having a size of from 100 nm to 150 μm in step (A), see, for example, U.S. Pat. No. 5,051,199. In a preferred embodiment, this particle size is obtained by milling. Suitable processes and apparatuses are known to those skilled in the art, for example wet milling in a ball mill. A preferred embodiment of the process of the invention thus comprises milling the mixture comprising at least one first material and at least one second material to particles having a size of from 100 nm to 150 μm before or during step (A).

In general, the mixtures to be treated by the process of the invention comprise at least one first material in an amount of from 0.001 to 1.0% by weight, based on the total mixture, and at least one second material, preferably at least one first material in an amount of from 0.001 to 0.5% by weight, based on the total mixture, and at least one second material, particularly preferably at least one first material in an amount of from 0.001 to 0.3% by weight, based on the total mixture, and at least one second material. The amount of the at least one second material preferably corresponds to the balance to 100% by weight.

Examples of sulfidic minerals present in the mixtures which can be used according to the invention are those mentioned above. In addition, sulfides of metals other than copper, for example sulfides of iron, lead, zinc or molybdenum, i.e. $FeS/FeS_2$, PbS, ZnS or $MoS_2$, can be present in the mixtures. Furthermore, oxidic compounds of metals and semimetals, for example silicates or borates or other salts of metals and semimetals, for example phosphates, sulfates or oxides/hydroxides/carbonates and further salts, for example azurite [$Cu_3(CO_3)_2(OH)_2$], malachite [$Cu_2[(OH)_2(CO_3)]$], barite ($BaSO_4$), monazite ((La—Lu)$PO_4$), can be present in the ore mixtures to be treated according to the invention. Further examples of the at least one first material which is separated off by means of the process of the invention are noble metals, for example Au, Ag, Pt, Pd, Rh, Ru etc., which can be present either in the native state or in the bound state in the mineral, also associated with other metals.

An ore mixture which is typically used and can be separated by the process of the invention comprises from 0.1 to 0.3% by weight, for example 0.2% by weight, of copper sulfide, for example $Cu_2S$ and/or bornite $Cu_5FeS_4$, possibly feldspar and/or chromium, iron, titanium and magnesium oxides and silicon dioxide ($SiO_2$) as balance to 100% by weight.

The individual steps of the process of the invention are described in detail below:

Step (A):

Step (A) of the process of the invention comprises contacting the mixture comprising at least one first material and at least one second material with at least one surface-active substance, if appropriate in the presence of at least one dispersion medium, with the surface-active substance binding selectively to the at least one first material, Suitable and preferred first and second materials are mentioned above.

For the purposes of the present invention, "surface-active substance" means a substance which is able to alter the surface of the particle to be separated off in the presence of other particles which are not to be separated off in such a way that attachment of a hydrophobic particle occurs as a result of hydrophobic interactions. Surface-active substances which can be used according to the invention bind to the at least one first material and thereby make the first material suitably hydrophobic.

The process of the invention is preferably carried out using a surface-active substance of the general formula (I)

$$A\text{-}Z \qquad (I)$$

which binds to the at least one first material, where

A is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-arylalkyl and Z is a group by means of which the compound of the general formula (I) binds to the at least one hydrophobic material.

In a particularly preferred embodiment, A is a linear or branched $C_4$-$C_{12}$-alkyl, very particularly preferably a linear $C_8$-alkyl. Heteroatoms which may be present according to the invention are selected from among Si, N, O, P, S and halogens such as F, Cl, Br and I.

In a further particularly preferred embodiment, Z is selected from the group consisting of anionic groups $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—PO_3^{2-}—(X)_n—CO_2^-$, $—(X)_n—CO_2^-$, $—(X)_n—COS^-$, $—(X)_n—C(S)NHOH$, $—(X)_n—S^-$ where X is selected from the group consisting of O, S, NH, $CH_2$ and n=0, 1 or 2, if appropriate with cations selected from the group consisting of hydrogen, $NR_4^+$ where the radicals R are each, independently of one another, hydrogen or $C_1$-$C_8$-alkyl, an alkali metal or alkaline earth metal. The anions mentioned and the corresponding cations form, according to the invention, uncharged compounds of the general formula (I).

In the case of noble metals, for example Au, Pd, Rh etc., particularly preferred surface-active substances are monothiols, dithiols and trithiols or 8-hydroxyquinolines, for example as described in EP 1200408 B1.

In the case of metal oxides, for example FeO(OH), $Fe_3O_4$, ZnO etc., carbonates, for example azurite $[Cu(CO_3)_2(OH)_2]$, malachite $[Cu_2[(OH)_2CO_3]]$, particularly preferred surface-active substances are octylphosphonic acid (OPA), $(EtO)_3Si$-A, $(MeO)_3Si$-A, with the abovementioned meanings for A. In a preferred embodiment of the process of the invention, no hydroxamates are used as surface-active substances for modifying metal oxides.

In the case of metal sulfides, for example $Cu_2S$, $MoS_2$, etc., particularly preferred surface-active substances are monothiols, dithiols and trithiols or xanthogenates, for example potassium octylxanthate.

In a preferred embodiment of the process of the invention, Z is $—(X)_n—CS_2^-$, $—(X)_n—PO_2^-$ or $—(X)_n—S^-$ where X is O and n is 0 or 1 and a cation selected from among hydrogen, sodium and potassium. Very particularly preferred surface-active substances are 1-octanethiol, potassium butylxanthate, potassium octylxanthate, octylphosphonic acid and (octylcarbethoxy)thiocarbonylethoxyamine.

Potassium octylxanthate (IV) and (octylcarbethoxy)thiocarbonylethoxyamine (V) are depicted below:

(IV)

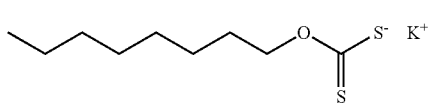

(V)

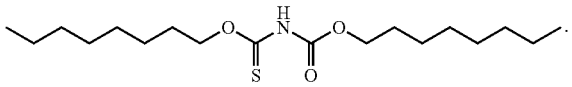

The at least one hydrophobicizing agent is used in step (A) of the process of the invention in an amount which is sufficient to hydrophobicize virtually all the at least one material present in the mixture to be treated. The amount of hydrophobicizing agent is therefore dependent on the concentration of the at least one first material in the mixture to be treated. The amount may also be dependent on the conditioning of the mixture to be treated. If the hydrophobicizing agent is, for example, added in a mill, the amount can be made smaller. A person skilled in the art will know how to determine the amount of hydrophobicizing agent.

In a preferred embodiment, the amount of hydrophobicizing agent in step (A) of the process of the invention is from 0.0001 to 0.2% by weight, preferably from 0.001 to 0.15% by weight, in each case based on the mixture of a mixture to be treated and hydrophobicizing agent.

The contacting in step (A) of the process of the invention can occur by all methods known to those skilled in the art. Step (A) can be carried out in bulk or in dispersion, preferably in suspension, particularly preferably in aqueous suspension.

In an embodiment of the process of the invention, step (A) is carried out in bulk, i.e. in the absence of a dispersion medium.

For example, the mixture to be treated and the at least one surface-active substance are combined and mixed without further dispersion medium in the appropriate amounts. Suitable mixing apparatuses are known to those skilled in the art, for example mills such as a ball mill.

In a preferred embodiment, step (A) is carried out in dispersion, preferably in suspension. Suitable dispersion media are all dispersion media in which the mixture from step (A) is not completely soluble. Suitable dispersion media for producing the slurry or dispersion in step (B) of the process of the invention are selected from the group consisting of water, water-soluble organic compounds, for example alcohols having from 1 to 4 carbon atoms, and mixtures thereof.

In a particularly preferred embodiment, the dispersion medium in the process of the invention is water, for example at a neutral pH, in particular at a pH of from 6 to 8.

In step (A), a suspension which has a solids content of, for example, from 10 to 50% by weight, preferably from 20 to 45% by weight, particularly preferably from 35 to 45% by weight, is preferably provided. According to the invention, it is also possible for the suspension obtained in step (A) to have a higher solids content of, for example, from 50 to 70% by weight and this solids content to be reduced to the specified values only in step (B) by dilution.

Step (A) of the process of the invention is generally carried out at a temperature of from 1 to 80° C., preferably from 20 to 40° C., particularly preferably at ambient temperature.

In the process of the invention, preference is given to step (A) being carried out under the action of sufficient shear energy for the ore present and the hydrophobicizing agent to come into contact to a sufficient extent. The shear energy which is preferably to be introduced in step (A) of the process of the invention is therefore dependent, for example, on the concentration of the material of value, the concentration of the hydrophobicizing agent and/or the solids content of the dispersion to be treated. The shear energy introduced in step (A) preferably has to be sufficiently high for effective hydrophobic flocculation between hydrophobic magnetic particles and hydrophobicized ore to be possible later in the process. According to the invention, this is preferably achieved by the use of a suitable mill, for example a ball mill.

Step (B):

The optional step (B) of the process of the invention comprises addition of at least one dispersion medium to the mixture obtained in step (A) in order to obtain a dispersion.

The mixture obtained in step (A) comprises, in one embodiment, if step (A) is carried out in bulk, at least one first material which has been modified on the surface by at least one surface-active substance and at least one second material. If step (A) is carried out in bulk, step (B) of the process of the invention is carried out, i.e. at least one suitable dispersion medium is added to the mixture obtained in step (A) in order to obtain a dispersion. A suspension having a solids content of, for example, from 10 to 50% by weight, preferably from 20 to 45% by weight, particularly preferably from 35 to 45% by weight, is preferably provided in step (B).

In general, the amount of dispersion medium added in step (A) and/or step (B) can, according to the invention, be selected so that a dispersion which is readily stirrable and/or flowable is obtained.

The present invention also relates, in particular, to the process according to the invention in which the dispersion obtained in step (A) and/or (B) has a solids content of from 10 to 50% by weight, particularly preferably from 20 to 45% by weight, particularly preferably from 35 to 45% by weight.

In the embodiment in which step (A) of the process of the invention is carried out in dispersion, step (B) is not carried out. However, in this embodiment, too, it is possible to carry out step (B), i.e. to add further dispersion medium in order to obtain a dispersion having a lower solids content.

Suitable dispersion media are all dispersion media which have been mentioned above in respect of step (A). In a particularly preferred embodiment, the dispersion medium in step (B) is water.

Thus, step (B) comprises either converting the mixture present in bulk from step (A) into a dispersion or converting the mixture already present in dispersion from step (A) into a dispersion having a lower solids content by addition of dispersion medium.

In a preferred embodiment of the process of the invention, step (B) is not carried out but instead step (A) is carried out in aqueous dispersion, so that step (A) directly gives a mixture in aqueous dispersion which has the correct concentration for it to be used in step (C) of the process of the invention.

The addition of dispersion medium in step (B) of the process of the invention can, according to the invention, be carried out by all methods known to those skilled in the art.

Step (C):

Step (C) of the process of the invention comprises treating the dispersion from step (A) or (B) with at least one hydrophobic magnetic particle so that the at least one first material which has been hydrophobicized in step (A) and to which the at least one surface-active substance is bound and the at least one magnetic particle agglomerate.

In step (C) of the process of the invention, it is possible to use all magnetic substances and materials known to those skilled in the art. In a preferred embodiment, the at least one magnetic particle is selected from the group consisting of magnetic metals, for example iron, cobalt, nickel and mixtures thereof, ferromagnetic alloys of magnetic metals, for example NdFeB, SmCo and mixtures thereof, magnetic iron oxides, for example magnetite, maghemite, cubic ferrites of the general formula (II)

$$M^{2+}{}_{x}Fe^{2+}{}_{1-x}Fe^{3+}{}_{2}O_4 \qquad \text{(II)}$$

where

M is selected from among Co, Ni, Mn, Zn and mixtures thereof and $x \leqq 1$, hexagonal ferrites, for example barium or strontium ferrite $MFe_6O_{19}$ where M=Ca, Sr, Ba, and mixtures thereof. The magnetic particles can additionally have an outer layer, for example of $SiO_2$.

In a particularly preferred embodiment of the present patent application, the at least one magnetic particle is magnetite $Fe_3O_4$ or cobalt ferrite $Co^{2+}{}_{x}Fe^{2+}{}_{1-x}Fe^{3+}{}_{2}O_4$ where $x \leqq 1$.

In a further preferred embodiment, the at least one magnetic particle is hydrophobicized on the surface by means of at least one hydrophobic compound. The hydrophobic compound is preferably selected from among compounds of the general formula (III)

$$B—Y \qquad \text{(III)},$$

where

B is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-arylalkyl and Y is a group by means of which the compound of the general formula (III) binds to the at least one magnetic particle.

In a particularly preferred embodiment, B is a linear or branched $C_6$-$C_{18}$-alkyl, preferably linear $C_8$-$C_{12}$-alkyl, very particularly preferably a linear $C_8$- or $C_{12}$-alkyl. Heteroatoms which may be present according to the invention are selected from among N, O, P, S and halogens such as F, Cl, Br and I.

In a further particularly preferred embodiment, Y is selected from the group consisting of $—(X)_n—SiHaI_3$, $—(X)_n—SiHHaI_2$, $—(X)_n—SiH_2HaI$ where HaI is F, Cl, Br, I, and anionic groups such as $—(X)_n—SiO_3^{3-}$, $—(X)_n—CO_2^-$, $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—CO_2^-$, $—(X)_n—CS_2^-$, $—(X)_n—COS^-$, $—(X)_n—C(S)NHOH$, $—(X)_n—S^-$ where X=O, S, NH, $CH_2$ and n=0, 1 or 2, and, if appropriate, cations selected from the group consisting of hydrogen, $NR_4^+$ where the radicals R are each, independently of one another, hydrogen or $C_1$-$C_8$-alkyl, an alkali metal, an alkaline earth metal or zinc, also $—(X)n-Si(OZ)_3$ where n=0, 1 or 2 and Z=charge, hydrogen or short-chain alkyl radical.

Very particularly preferred hydrophobicizing substances of the general formula (III) are dodecyltrichlorosilane, octylphosphonic acid, lauric acid, oleic acid, stearic acid or mixtures thereof.

The treatment of the dispersion from step (A) or (B) with at least one hydrophobic magnetic particle in step (C) of the process of the invention can be carried out by all methods known to those skilled in the art.

In one embodiment of the process of the invention, the at least one magnetic particle is dispersed in a suitable dispersion medium and then added to the dispersion from step (A) or (B). Suitable dispersion media are all dispersion media in which the at least one magnetic particle is not completely soluble. Suitable dispersion media for dispersion in step (C) of the process of the invention are selected from the group consisting of water, water-soluble organic compounds and mixtures thereof, particularly preferably water. It is possible to use the same dispersion medium in step (C) as in step (B). In general, the amount of dispersion medium for predispersing the magnetic particles can, according to the invention, be selected so that a slurry or dispersion which is readily stirrable and/or flowable is obtained. The dispersion of the magnetic particles can, according to the invention, be produced by all methods known to those skilled in the art. In a preferred embodiment, the magnetic particles to be dispersed and the appropriate amount of dispersion medium or mixture of dispersion media are combined in a suitable reactor, for example a glass reactor, and stirred by means of apparatuses known to those skilled in the art, for example in a glass tank using a mechanically operated propeller stirrer, for example at a temperature of from 1 to 80° C., preferably at ambient temperature.

The treatment of the dispersion from step (B) with at least one hydrophobic magnetic particle is generally carried out by combining the two components using methods known to those skilled in the art. In a preferred embodiment, the hydrophobicized magnetic particle is added in solid form to a dispersion of the mixture to be treated. In a further preferred embodiment, the two components are present in dispersed form.

Step (C) is generally carried out at a temperature of from 1 to 80° C., preferably from 10 to 30° C. Step (C) of the process of the invention can be carried out in all apparatuses known to those skilled in the art, for example in a mill, preferably in a ball mill. In a particularly preferred embodiment of the process of the invention, step (C) is carried out in the same apparatus, preferably a mill, in which step (A) and, if appropriate, step (B) are carried out.

In step (C), the at least one magnetic particle forms an agglomerate with the hydrophobic material of the mixture to be treated. The bond between the two components is based on hydrophobic interactions. In general, no bonding interaction occurs between the at least one magnetic particle and the hydrophilic component of the mixture, so that no agglomeration between these components occurs. Thus, agglomerates of the at least one hydrophobic material and the at least one magnetic particle are present in addition to the at least one hydrophilic material in the mixture after step (C).

Step (D):

Step (D) of the process of the invention comprises separation of the agglomerate from step (C) from the mixture by application of a magnetic field.

In a preferred embodiment, step (D) can be carried out by introducing a permanent magnet into the reactor in which the mixture from step (C) is present. In a preferred embodiment, a dividing wall composed of nonmagnetic material, for example the glass wall of the reactor, is present between the permanent magnet and the mixture to be treated. In a further preferred embodiment of the process of the invention, an electromagnet which is only magnetic when an electric current flows is used in step (D). Suitable apparatuses are known to those skilled in the art.

Step (D) of the process of the invention can be carried out at any suitable temperature, for example from 10 to 60° C.

During step (D), the mixture is preferably continually stirred by means of a suitable stirrer.

In step (D), the agglomerate from step (C) may, if appropriate, be separated off by all methods known to those skilled in the art, for example by draining of the liquid comprising the hydrophilic part of the suspension from the bottom valve of the reactor used for step (D) or pumping away the components of the suspension which have not been held by the at least one magnet through a hose.

Step (E):

The optional step (E) of the process of the invention comprises dissociation of the agglomerate separated off in step (D) in order to obtain the at least one first material and the at least one magnetic particle separately. Step (E) according to the invention can be carried out when the at least one first material is to be obtained separately. In a preferred embodiment of the process of the invention, the dissociation in step (E) is carried out in a nondestructive manner, i.e. the individual components present in the dispersion are not altered chemically. For example, the dissociation according to the invention is not effected by oxidation of the hydrophobicizing agent, for example to give the oxidation products or degradation products of the hydrophobicizing agent.

The dissociation can be carried out by all methods known to those skilled in the art which are suitable for dissociating the agglomerate in such a way that the at least one magnetic particle can be recovered in reusable form. In a preferred embodiment, the magnetic particle which has been split off is reused in step (C).

In a preferred embodiment, the dissociation in step (C) of the process of the invention is effected by treating the agglomerate with a substance selected from the group consisting of organic solvents, basic compounds, acidic compounds, oxidants, reducing agents, surface-active compounds and mixtures thereof.

Examples of suitable organic solvents are methanol, ethanol, propanol, for example n-propanol or isopropanol, aromatic solvents, for example benzene, toluene, xylenes, ethers, for example diethyl ether, methyl t-butyl ether, ketones, for example acetone, and mixtures thereof. Examples of basic compounds which can be used according to the invention are aqueous solutions of basic compounds, for example aqueous solutions of alkali metal and/or alkaline earth metal hydroxides, for example KOH, NaOH, aqueous ammonia solutions, aqueous solutions of organic amines of the general formula $R^2{}_3N$, where the radicals $R^2$ are selected independently from the group consisting of $C_1$-$C_8$-alkyl, optionally substituted by further functional groups. In a preferred embodiment, step (D) is carried out by adding aqueous NaOH solution to a pH of 13, for example for separating off $Cu_2S$ modified with OPA. The acidic compounds can be mineral acids, for example HCl, $H_2SO_4$, $HNO_3$ or mixtures thereof, organic acids, for example carboxylic acids. As oxidant, it is possible to use, for example, $H_2O_2$, for example as 30% strength by weight aqueous solution (perhydrol). To separate off $Cu_2S$ modified with thiols, preference is given to using $H_2O_2$ or $Na_2S_2O_4$.

Examples of surface-active compounds which can be used according to the invention are nonionic, anionic, cationic and/or zwitterionic surfactants.

In a preferred embodiment, the agglomerate of hydrophobic material and magnetic particle is dissociated by means of an organic solvent, particularly preferably by means of acetone, diesel, Solvesso® or Shellsol®. This process can also be aided mechanically. In a preferred embodiment, ultrasound is used for aiding of the dissociation process.

In general, the organic solvent is used in an amount which is sufficient to dissociate virtually all the agglomerate. In a preferred embodiment, from 20 to 100 ml of the organic solvent are used per gram of agglomerate of hydrophobic material and magnetic particle which is to be dissociated.

According to the invention, the at least one first material and the at least one magnetic particle are present as a dispersion in said dissociation reagent, preferably an organic solvent, after the dissociation.

The at least one magnetic particle can be separated off from the dispersion comprising this at least one magnetic particle and the at least one first material by means of a permanent magnet or electromagnet. Details of this separation are analogous to step (D) of the process of the invention.

The first material to be separated off, preferably the metal compound to be separated off, is preferably separated from the organic solvent by distilling off the organic solvent. The first material which can be obtained in this way can be purified by further processes known to those skilled in the art. The solvent can, if appropriate after purification, be recirculated to the process of the invention.

EXAMPLES

Example 1

Original tailings from a mine, in which the copper content is determined as 0.2% by weight, are used.

100 g of dried material are weighed together with 160 ml (535 g) of $ZrO_2$ beads (diameter=1.7-2.3 mm), 0.13 g of (octylcarbethoxy)thiocarbonylethoxyamine ($H_{17}C_8OC{=}ONHC{=}SOC_8H_{17}$), 62 ml of water and 1 ml of petroleum spirit into a $ZrO_2$ container and conditioned at 200 rpm for 30 minutes. 2.0 g of hydrophobic magnetite ($Fe_3O_4$ modified with octylphosphonic acid, diameter=4 μm) are subsequently added and the mixture is once again milled at 200 rpm for 30 minutes.

The mixture obtained in this way is diluted with water so that the mixture has a solids content of 40% by weight. The magnetic constituents are subsequently separated magnetically from the nonmagnetic constituents by holding a Co/Sm magnet against the outer wall of the container.

After drying, 2.7 g of magnetic material having a copper content of 5.2% by weight was obtained from the 100 g of material used and the 2.0 g of magnetite used. This corresponds to 0.14 g (70%) of the copper present in the tailings treated.

Example 2

Tailings from an original mine, in which the copper content is determined as 0.2% by weight, are used.

100 g of dried material are weighed together with 160 ml (535 g) of $ZrO_2$ beads (diameter=1.7-2.3 mm), 0.13 g of potassium octylxanthate, 62 ml of water and 1 ml of petroleum spirit into a $ZrO_2$ container and conditioned at 200 rpm for 30 minutes. 2.0 g of hydrophobic magnetite ($Fe_3O_4$ modified with octylphosphonic acid, diameter=4 μm) are subsequently added and the mixture is once again milled at 200 rpm for 30 minutes.

The mixture obtained in this way is diluted with water so that the mixture has a solids content of 40% by weight. The magnetic constituents are subsequently separated magnetically from the nonmagnetic constituents by holding a Co/Sm magnet against the outer wall of the container.

After drying, 2.41 g of magnetic material having a copper content of 4.5% by weight was obtained from the 100 g of material used and the 2 g of magnetite used. This corresponds to 0.108 g (54%) of the copper present in the tailings treated.

Example 3

Tailings from an original mine, in which the copper content is determined as 0.1% by weight, are used.

100 g of dried material, 100 g of $ZrO_2$ beads (diameter=1.7-2.3 mm), 2 g of potassium octylxanthate and 20 g of water are weighed into a $ZrO_2$ container and conditioned at 200 rpm for 30 minutes. 2 g of magnetite ($Fe_3O_4$ modified with octylphosphonic acid, diameter=4 μm) and 0.2 g of Shellsol are subsequently added and the mixture is once again milled at 150 rpm for 5 minutes.

The mixture obtained in this way is diluted with water so that the mixture has a solids content of 40% by weight. The magnetic constituents are subsequently separated magnetically from the nonmagnetic constituents by holding a Co/Sm magnet against the outer wall of the container.

After drying, 2.67 g of magnetic material having a copper content of 3.1% by weight was obtained from the 100 g of material used and the 2 g of magnetite used. This corresponds to 0.083 g (83%) of the copper present in the tailings treated.

The invention claimed is:

1. A process for separating at least one first material from a mixture comprising at least one first material and at least one second material, the method comprising:

(A) contacting the mixture comprising the at least one first material and at least one second material with at least one surface-active substance, optionally in the presence of at least one dispersion medium, with the surface-active substance binding to the at least one first material, to obtain a first intermediate;

(B) optionally, adding at least one dispersion medium to the first intermediate obtained in (A) in order to obtain a dispersion;

(C) treating the first intermediate from (A) or the dispersion (B) with at least one hydrophobic magnetic particle so that the at least one first material to which the at least one surface-active substance is bound and the at least one hydrophobic magnetic particle agglomerate, and give an agglomerate in a second intermediate;

(D) separating the agglomerate from (C) from the second intermediate by application of a magnetic field; and (E) optionally, dissociating the agglomerate separated off in (D) in order to obtain the at least one first material and the at least one magnetic particle separately, wherein the first material is at least one metal compound selected from the group consisting of a compound of a transition metal, a compound of a sulfidic ore, a compound of an oxidic ore, a compound of a carbonate-comprising ore, a compound of an oxidic and carbonate-comprising ore, and a noble metal in elemental form, and wherein the mixture comprises (1) the at least one first material in an amount of from 0.001 to 1.0% by weight, based on a total weight of the mixture, and (2) the at least one second material.

2. The process of claim 1, wherein the surface-active substance is a substance of formula (I)

$$A\text{-}Z \qquad (I),$$

wherein

A is linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, or $C_6$-$C_{30}$-arylalkyl, and Z is a group by which the compound of formula (I) binds to the at least one hydrophobic material.

3. The process of claim 2, wherein Z is selected from the group consisting of $—(X)_n—PO_3^{2-}$, $—(X)_n—POS_2^{2-}$, $—(X)_n—PS_3^{2-}$, $—(X)_n—PS_2^{-}$, $—(X)_n—POS^{-}$, $—(X)_n—PO_2^{-}$, $—(X)_n—PO_3^{2-}$, $—(X)_n—CO_2^{-}$, $—(X)_n—CS_2^{-}$, $—(X)_n—COS^{-}$, $—(X)_n—C(S)NHOH$, and $—(X)_n—S^{-}$, wherein X is selected from the group consisting of O, S, NH, and $CH_2$, and wherein n is 0, 1, or 2, optionally with at least one cation selected from the group consisting of hydrogen, an alkali metal, an alkaline earth metal, and $NR_4^+$ wherein the radicals R are each, independently of one another, hydrogen or $C_1$-$C_8$-alkyl.

4. The process of claim 3, wherein an amount of surface-active substance in (A) is from 0.0001 to 0.2% by weight, based on the mixture of a mixture to be treated and hydrophobicizing agent.

5. The process of claim 3, wherein the hydrophobic magnetic particle is at least one selected from the group consisting of a magnetic metal, a ferromagnetic alloy of at least one magnetic metal, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is selected from among Co, Ni, Mn, Zn and mixtures thereof and $x \leqq 1$.

6. The process of claim 3, wherein the dispersion medium is water.

7. The process of claim 3, wherein the mixture comprising at least one first material and at least one second material is milled to particles having a size of from 100 nm to 150 μm before or during the contacting (A).

8. The process of claim 1, wherein an amount of surface-active substance in (A) is from 0.0001 to 0.2% by weight, based on the mixture of a mixture to be treated and hydrophobicizing agent.

9. The process of claim 2, wherein the hydrophobic magnetic particle is at least one selected from the group consisting of a magnetic metal, a ferromagnetic alloy of at least one magnetic metal, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is selected from among Co, Ni, Mn, Zn and mixtures thereof and $x \leqq 1$.

10. The process of claim 2, wherein the dispersion medium is water.

11. The process of claim 2, wherein the mixture comprising at least one first material and at least one second material is milled to particles having a size of from 100 nm to 150 μm before or during the contacting (A).

12. The process of claim 1, wherein an amount of surface-active substance in (A) is from 0.0001 to 0.2% by weight, based on the mixture of a mixture to be treated and hydrophobicizing agent.

13. The process of claim 12, wherein the hydrophobic magnetic particle is at least one selected from the group consisting of a magnetic metal, a ferromagnetic alloy of at least one magnetic metal, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is selected from among Co, Ni, Mn, Zn and mixtures thereof and $x \leqq 1$.

14. The process of claim 12, wherein the dispersion medium is water.

15. The process of claim 1, wherein the second material is selected from the group consisting of an oxidic metal compound and a hydroxidic metal compound.

16. The process of claim 15, wherein the hydrophobic magnetic particle is at least one selected from the group consisting of a magnetic metal, a ferromagnetic alloy of at least one magnetic metal, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is selected from among Co, Ni, Mn, Zn and mixtures thereof and $x \leqq 1$.

17. The process of claim 1, wherein the hydrophobic magnetic particle is at least one selected from the group consisting of a magnetic metal, a ferromagnetic alloy of at least one magnetic metal, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is selected from among Co, Ni, Mn, Zn and mixtures thereof and $x \leqq 1$.

18. The process of claim 1, wherein the dispersion medium is water.

19. The process of claim 1, wherein the mixture comprising at least one first material and at least one second material is milled to particles having a size of from 100 nm to 150 μm before or during the contacting (A).

20. The process of claim 1, wherein the at least one of the first intermediate obtained in (A) and the dispersion obtained in (B), has a solids content of from 10 to 50% by weight.

* * * * *